US005650088A

United States Patent [19]

Kodama

[11] Patent Number: 5,650,088

[45] Date of Patent: Jul. 22, 1997

[54] TREATING SOLUTION FOR GOLD-PLATED MATERIAL

[75] Inventor: Atsushi Kodama, Kouza-gun, Japan

[73] Assignee: Nippon Mining & Metals Company, Ltd., Tokyo, Japan

[21] Appl. No.: 556,569

[22] Filed: Nov. 13, 1995

[30] Foreign Application Priority Data

Mar. 24, 1995 [JP] Japan ..... 7-065762
Mar. 24, 1995 [JP] Japan ..... 7-065764

[51] Int. Cl.[6] ..... C10M 137/00

[52] U.S. Cl. ..... 508/257; 508/258; 508/276

[58] Field of Search ..... 252/32, 32.5, 56 R, 252/57

[56] References Cited

U.S. PATENT DOCUMENTS 3,914,179 10/1975 Byford et al. ..... 252/32.5

5,399,274 3/1995 Marcus ..... 252/49.3

OTHER PUBLICATIONS

"Organic Sealing Solution for gold–plated metal, sealing and sealed electrical connector." Fukamachi et al. Jun. 1992 chemical abstracts.

*Primary Examiner*—Arun S. Phasge
*Attorney, Agent, or Firm*—Flynn, Thiel, Boutell & Tanis, P.C.

[57] ABSTRACT

A treating solution for a gold- or gold-alloy-plated material having nickel or a nickel-containing alloy as an underplating on a metallic material, the solution including a particular inhibitor, such as benzotriazole, a lubricant containing a particular fatty acid, and an emulsifier containing a particular alkyl phosphate. Treating is performed by coating the gold or gold-alloy-plated material with the treating solution or by electrolyzing in the treating solution using the gold-plated material as an anode.

5 Claims, No Drawings

TREATING SOLUTION FOR GOLD-PLATED MATERIAL

BACKGROUND OF THE INVENTION

1. Field of the Invention

The present invention relates to a treating solution for a gold- or gold alloy plated material having nickel or a nickel-containing alloy as an underplating on a metallic material, such as an iron alloy, iron, stainless steel, or high-nickel alloy, and a treating method using the same.

2. Description of the Prior Art

A material comprising brass or phosphor bronze, an underplating of nickel provided thereon, and a gold plating provided on the underplating is generally used as a connector which is a coupling part for electronic equipment. Since, however, gold is expensive, various methods are used for lowering the production cost of connectors. A representative method is to decrease the thickness of the gold plating. This method, however, involves a problem that the number of pinholes created in the gold plating increases exponentially with a decrease in the thickness of the gold plating, resulting in remarkably lowered corrosion resistance.

One method for solving this problem is treating for sealing or the like. According to this method, the surface of the gold plating is treated with various inorganic or organic chemicals to clog the pinholes in the gold plating, thereby improving the corrosion resistance. A treating solution used in such a method is classified into two systems, organic and aqueous. For the organic system, a halogenated organic solvent is generally used as a solvent. Since this poses the problem of the destruction of the ozonosphere and the like, the use of the organic treating solution is greatly restricted at the present time. On the other hand, for the aqueous system, water is used as the solvent, poses no problem of environmental pollution. Since, however, a sparingly water-soluble lubricant, which has been used in conventional organic treating solutions, such as paraffin, cannot be used in the water system, a plating which has been treated with the water system has low lubricity, which renders the durability of connectors treated with the water system inferior to that of connectors treated with the organic solvent system.

Accordingly, a treating solution and a treating method are needed which pose no problem associated with environmental pollution and offer a treating effect equal or superior to that attained by the prior art.

SUMMARY OF THE INVENTION

An object of the present invention is to provide an improved treating solution which can meet the above demand and a treating method using the same.

The present inventors have made studies with a view to solving the above problem, which has led to the development of the following surface treating solution and method. Specifically, the present invention provides:

(1) A treating solution for a gold- or gold alloy-plated material .having nickel or a nickel-containing alloy as an underplating on a metallic material, the treating solution comprising:

0.001 to 1% by weight in total of at least one inhibitor selected from the group consisting of benzotriazole compounds represented by the following general formula (1), mercaptobenzothiazole compounds represented by the general formula (2), and triazine compounds represented by the general formula (3);

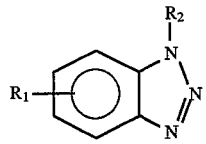

(1)

wherein $R_1$ represents hydrogen, an alkyl, or a substituted alkyl and $R_2$ represents an alkali metal, hydrogen, an alkyl, or a substituted alkyl.

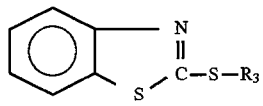

(2)

wherein $R_3$ represents an alkali metal or hydrogen.

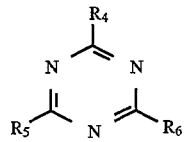

(3)

wherein $R_4$ represents -SH, an alkyl- or aryl-substituted amino group, or an alkyl-substituted imidazolylalkyl, $R_5$ and $R_6$ represent each $-NH_2$, -SH, The inhibitor as the first indispensable component of the treating solution according to the present invention is at least one member selected from the group consisting of the following compounds, i.e., benzotriazole compounds, mercaptobenzothiazole compounds, and triazine compounds. The selected compound(s) is added to the treating solution. These inhibitors react with nickel as an underlying metal present within pinholes of a gold plating to give a complex compound which clogs the pinholes, thereby improving the corrosion resistance of the gold plating. The benzotriazole compounds usable in the present invention are represented by the general formula (1)

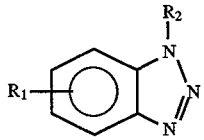

(1)

wherein $R_1$ represents hydrogen, an alkyl, or a substituted alkyl and $R_2$ represents an alkali metal, hydrogen, an alkyl, or a substituted alkyl. Among the compounds represented by the general formula (1), preferred are, for example, benzotriazole (both $R_1$ and $R_2$ are hydrogen), 1-methylbenzotriazole ($R_1$ is hydrogen with $R_2$ being methyl), tolyltriazole ($R_1$ is methyl with $R_2$ being hydrogen), and 1-(N,N-dioctylaminomethyl)benzotriazole ($R_1$ is hydrogen with $R_2$ being N,N-dioctylaminomethyl).

The mercaptobenzothiazole compounds usable in the present invention are represented by the general formula (2) or -SM wherein M represents an alkali metal;

0.05 to 2% by weight in total of at least one lubricant selected from the group consisting of fatty acids represented by the following general formula (4)

$$R_7\text{-COOH} \quad (4)$$

wherein $R_7$ represents a saturated or unsaturated chain hydrocarbon radical having 10 to 20 carbon atoms; and 0.05 to 2% by weight in total of at least one emulsifier selected from the group consisting of a monoalkyl phosphate represented by the following general formula (5) and a dialkyl phosphate represented by the following general formula (6)

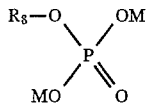

(5)

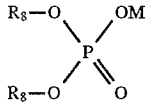

(6)

wherein $R_8$ represents an alkyl or a substituted alkyl and M represents hydrogen or an alkali metal.

(2) A treating method comprising coating a gold- or gold alloy plated material having nickel or a nickel-containing alloy as an underplating on a metallic material with a treating solution according to the above item 1.

(3) A treating method comprising carrying out electrolysis in a treating solution according to the above item (1) by using as an anode a gold- or gold alloy plated material having nickel or a nickel-containing alloy as an underplating on a metallic material.

DETAILED DESCRIPTION OF THE PREFERRED EMBODIMENTS

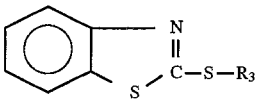

(2)

wherein $R_3$ represents an alkali metal or hydrogen. Among the compounds represented by the general formula (2), preferred are, for example, mercaptobenzothiazole, the sodium salt of mercaptobenzothiazole, and the potassium salt of mercaptobenzothiazole. In the general formula (2), when $R_3$ represents an alkali metal, the dissolution of the mercaptobenzothiazole compound in water can be facilitated.

The triazine compounds are represented by the general formula (3)

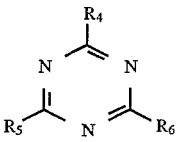

(3)

wherein $R_4$ represents -SH, an alkyl- or aryl-substituted amino group, or an alkyl-substituted imidazolylalkyl and $R_5$ and $R_6$ represent each $-NH_2$, -SH, or -SM wherein M represents an alkali metal. Among the compounds represented by the general formula (3), preferred are, for example,

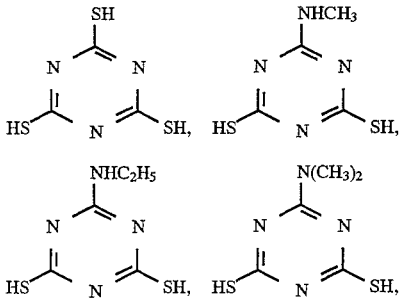

-continued

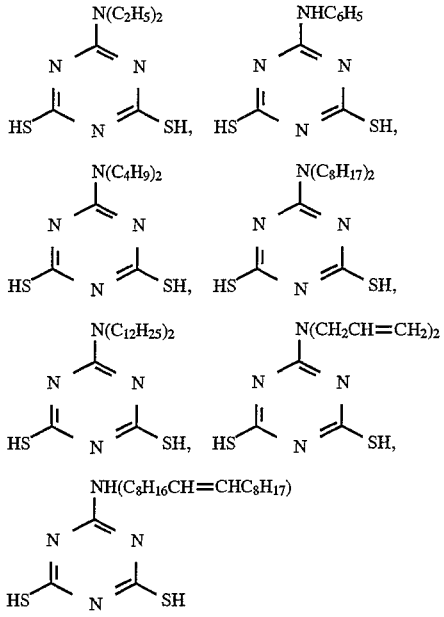

Additional preferred compounds include an alkali metal salt, such as a Na or K salt, of the above compounds. In the general formula (3), when $R_5$ and $R_6$ are both -SM, the dissolution of the triazine compound in water can be facilitated. The amount of the inhibitor added is in the range of from 0.001 to 1% by weight. When it is less than 0.001% by weight, no treating effect can be attained, while when it exceeds by weight, an adverse effect on the contact resistance occurs.

The lubricant as the second indispensable component of the treating solution according to the present invention is at least one member selected from the group consisting of fatty acids. The addition of the selected fatty acid(s) to the treating solution contributes to an improvement in the lubricity of the gold-plated material. The fatty acids usable in the present invention are represented by the general formula (4)

$$R_7\text{-COOH} \quad (4)$$

wherein $R_7$ represents a saturated or unsaturated chain hydrocarbon radical having 10 to 20 carbon atoms. Among the compounds represented by the general formula (4), preferred are, for example, lauric acid, myristic acid, palmitic acid, stearic acid, oleic acid, and linoleic acid. The total amount thereof is in the range of from 0.05 to 2% by weight. When it is less than 0.05% by weight, no lubricating effect can be attained, while when it exceeds 2% by weight, an adverse effect in the appearance of the material after treating occurs.

The emulsifier as the third indispensable component of the present invention is at least one member selected from the group consisting of the following compounds, i.e., monoalkyl phosphates and dialkyl phosphates. When the selected compound(s) is added to the treating solution, it serves as an emulsifier for a lubricant. It further exhibits lubricating action.

The monoalkyl phosphates used in the present invention are represented by the general formula (5)

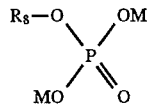

(5)

wherein $R_8$ represents an alkyl or a substituted alkyl and M represents hydrogen or an alkali metal. Among the compounds represented by the general formula (5), preferred are lauryl acid phosphoric monoesters (monolauryl phosphates).

The dialkyl phosphates are represented by the general formula (6)

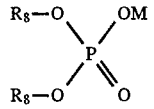

(6)

wherein $R_8$ represents an alkyl or a substituted alkyl and M represents hydrogen or an alkali metal. Among the compounds represented by the general formula (6), preferred are, for example, lauryl acid phosphoric diesters (dilauryl phosphates). The amount of the emulsifier added is in the range of from 0.05 to 2% by weight. When it is less than 0.05% by weight, no emulsification effect can be attained, while when it exceeds 2% by weight, an adverse effect on solderability occurs. In the treating solution comprising the above components, a solvent therefor may be selected from among water and organic halogen-free solvents, such as ethanol, acetone, n-paraffin or the like. Water is best suited as the solvent for reasons of economy, inflammability and the like. When the solvent is water, heating of the solution to 40° to 80° C. accelerates the emulsification of the components in water and, in addition, facilitates drying of the material after treating.

Treating may be carried out by any method such as dipping of a plated material in a treating solution or spraying or coating of a plated material with a treating solution. The present inventors have found that, independently of whether the plated material is in the form of a plate, a bar, or a pressed part, if the plated material has just been plated, that is, in a continuous line, various functions of the treating can be enhanced by carrying out the treating in the line. Further, fabrication of a plated material by a press or the like followed by treating the fabricated article with the treating solution of the present invention is also useful. Even in the case of a metallic material which has been thus treated after plating, the function of this treating is almost lost in the step of removing, through cleaning, a press oil deposited during the step of pressing subsequent to the treating. Accordingly, it is useful to again carry out the treatment of the present invention.

In another embodiment of the treating method according to the present invention, a plated material is immersed in a treating solution, and a direct current or a pulse current is passed across electrodes using the plated material as an anode. When the plated material is used as the anode, the inhibitor in the treating solution is adsorbed onto an underlying metal present within pinholes of the plated material, preventing the plated material from being corroded. The interelectrode voltage during electrolysis is in the range of from 1 to 5 V. When the interelectrode voltage is less than 1 V, no satisfactory effect can be attained. On the other hand, when it exceeds 5 V, the dissolution of the plating film is increased, making it impossible to attain the treating effect. The current density is not less than 0.1 $A/m^2$. When it is less than 0.1 $A/m^2$, no treating effect can be attained. The treating time is preferably 1 to 10 sec.

The treating method described above in connection with the coating of a plated material with a treating solution can be applied to the above method. Specifically, independently of whether the plated material is in the form of a plate, a bar, or a pressed part, if the plated material has just been plated, that is, in a continuous line, various functions of the treating can be enhanced by carrying out the treating in the line. Further, fabrication of a plated material by a press or the like followed by treating of the fabricated article with the treating solution of the present invention is also useful. Even in the case of a metallic material which has been sealed after plating, the function of treating is almost lost during the step of removing, through cleaning, a press oil deposited during the step of pressing subsequent to the treating. Accordingly, it is useful to again carry out the treatment of the present invention.

The present invention will now be described in more detail with reference to the following Examples.

EXAMPLE 1

A 0.2 mm-thick cold-rolled material of phosphor bronze (C5210) as a spring material was press-molded into male and female continuous terminals. These were electroplated through a reel-to-reel continuous plating line. In the plating line, the terminals were degreased, pickled, and then plated with nickel in a Watt's bath to form a 1 μm-thick plating or plated with an 80%Pd-20%Ni alloy in an alkali bath to form a 0.5 μm-thick plating. Thereafter, contact points of the terminals were plated with gold or a gold-cobalt alloy to form a 0.1 μm-thick plating. In the continuous plating line, the step of treating was provided after the gold or gold-cobalt plating step, and the continuous terminals were passed and dipped in a treating solution to treat the continuous terminals. In this case, ion-exchanged water was used as a solvent for the treating solution, and the treating solution temperature was brought to 60° C. The thus treated male and female terminals were cut out from a carrier section and a lead wire was press-bonded to the terminals, which were then fitted into each other and applied to an evaluation test.

The contact resistance was measured under the conditions of a direct current of 10 mA and an open-circuit voltage of 200 mV. The lubricity was evaluated based on the insertion and removal forces of connector terminals after treating. Regarding the corrosion resistance, a sulfur dioxide gas corrosion test was carried out under the following conditions, and, after the test, the surface observation and the measurement of the contact resistance for each sample were carried out to evaluate the corrosion resistance.

Composition of gas: $SO_2$ 10 ppm

Temp.: 40°±2° C.

Humidity: 80±5% RH

Time: 240 hr

The components of the treating solutions and the test results of samples after treating are given in Table 1.

TABLE 1

| | Kind of plating | | Treating solution | | | Test results | | | |
|---|---|---|---|---|---|---|---|---|---|
| | | | Inhibitor | Lubricant | Emulsifier | Initial | Appearance | Contact | |
| No. | Underlaying metal | Top plating metal | concentration (wt. %) | concentration (wt. %) | concentration (wt. %) | contact resistance | after corrosion test | resistance after corrosion test | Lubricity |
| | | | Invention Examples | | | | | | |
| 1 | Ni | Au | A-1 0.01% | B-1 0.3% | C-1 0.3% | ○ | ○ | ○ | ○ |
| 2 | Ni | Au | A-1 0.01% | B-1 0.3% | C-2 0.3% | ○ | ○ | ○ | ○ |
| 3 | Ni | Au | A-1 0.01% | B-1 0.3% | C-1 0.15%<br>C-2 0.15% | ○ | ○ | ○ | ○ |
| 4 | Ni | Au | A-2 0.01% | B-1 0.3% | C-1 0.3% | ○ | ○ | ○ | ○ |
| 5 | Ni | Au | A-3 0.01% | B-1 0.3% | C-1 0.3% | ○ | ○ | ○ | ○ |
| 6 | Ni | Au | A-1 0.005%<br>A-2 0.005% | B-1 0.3% | C-1 0.3% | ○ | ○ | ○ | ○ |
| 7 | Pd—Ni | Au | A-2 0.01% | B-1 0.3% | C-1 0.3% | ○ | ○ | ○ | ○ |
| 8 | Ni | Au—Co | A-2 0.01% | B-1 0.3% | C-1 0.3% | ○ | ○ | ○ | ○ |
| 9 | Ni | Au | Untreated | | | ○ | x | x | x |
| 10 | Ni | Au | A-2 0.01% | | | ○ | ○ | ○ | x |
| 11 | Ni | Au | A-2 0.01% | | C-1 0.3% | ○ | ○ | ○ | ■ |
| 12 | Ni | Au | | B-1 0.3% | C-1 0.3% | ○ | x | x | ○ |
| 13 | Ni | Au | | | C-1 0.3% | ○ | x | x | ■ |
| 14 | Ni | Au | A-2 0.0005% | B-1 0.3% | C-1 0.3% | ○ | ■ | ■ | ○ |
| 15 | Ni | Au | A-2 2.0% | B-1 0.3% | C-1 0.3% | ■ | ■ | ■ | ○ |
| 16 | Ni | Au | A-2 0.01% | B-1 0.01% | C-1 0.3% | ○ | ○ | ○ | ■ |
| 17 | Ni | Au | A-2 0.01% | B-1 5.0% | C-1 0.3% | x | ○ | x | ○ |
| 18 | Ni | Au | A-2 0.01% | B-1 0.3% | C-1 0.01% | ○ | ○ | ○ | ■ |
| 19 | Ni | Au | A-2 0.01% | B-1 0.3% | C-1 5.0% | x | ○ | x | ○ |

Note 1)
Symbols for representing components of treating solutions in the table are as follows:
A-1: benzotriazole
A-2: sodium salt of mercaptobenzothiazole
A-3: sodium salt of 1,3,5-triazinethiol
B-1: oleic acid
C-1: lauryl acid phosphoric monoester (monolauryl phosphate)
C-2: lauryl acid phosphoric diester (dilauryl phosphate)
Note 2)
Criteria of test
(1) Initial contact resistance and contact resistance after corrosion test
○: not more than 10 mΩ
■: more than 10 to 20 mΩ
x: more than 20 mΩ
(2) Appearance after corrosion test
○: not more than 10 in the number of corrosion points in an area of 5 cm square of an enlarged photograph at a magnification of 50
■: more than 10 to 50 in the number of corrosion points in an area of 5 cm square of an enlarged photograph at a magnification of 50
x: more than 50 in the number of corrosion points in an area of 5 cm square of an enlarged photograph at a magnification of 50
(3) Lubricity (insertion and removal forces)
○: insertion force of not more than 100 g per pin and removal force of not more than 50 g per pin
■: insertion force of more than 100 to 150 g per pin and removal force of more than 50 to 100 g per pin
x: insertion force of more than 150 g per pin and removal force of more than 100 g per pin

EXAMPLE 2

A 0.2 mm-thick cold-rolled spring material of phosphor bronze (C5210) was press-molded into male and female continuous terminals. These were electroplated through a reel-to-reel continuous plating line. In the plating line, the terminals were degreased, pickled, and then plated with nickel in a Watt's bath to form a 1 μm-thick plating or plated with an 80%Pd-20%Ni alloy in an alkali bath to form a 0.5 μm-thick plating. Thereafter, contact points of the terminals were plated with gold or a gold-cobalt alloy to form a 0.1 μm-thick plating. In the continuous plating line, the step of treating was provided after the gold or gold-cobalt plating step, and the continuous terminals were passed in a treating solution and treated for 5 sec under the conditions of a treating solution temperature of 60° C., an interelectrode voltage of 2 V, and a current density of 0.6 A/m$^2$. The thus treated male and female terminals were cut out from a carrier section and a lead wire was press-bonded to the terminals, which were then fitted into each other and subjected to an evaluation test.

The contact resistance was measured under the conditions of a direct current of 10 mA and an open-circuit voltage of 200 mV. The lubricity was evaluated based on the insertion and removal forces of connector terminals after treating. Regarding the corrosion resistance, a sulfur dioxide gas corrosion test was carried out under the following conditions, and, after the test, the surface observation and the measurement of the contact resistance for samples were carried out to evaluate the corrosion resistance.

Composition of gas: $SO_2$ 10 ppm
Temp.: 40°±2° C.
Humidity: 80±5% RH

Time: 240 hr

The test results are given in Table 2.

TABLE 2

| | Kind of plating | | Treating solution | | | Test results | | | |
|---|---|---|---|---|---|---|---|---|---|
| | | | Inhibitor | Lubricant | Emulsifier | Initial | Appearance | Contact | |
| No. | Underlaying metal | Top plating metal | concentration (wt. %) | concentration (wt. %) | concentration (wt. %) | contact resistance | after corrosion test | resistance after corrosion test | Lubricity |
| | | | Invention Examples | | | | | | |
| 1 | Ni | Au | A-1 0.01% | B-1 0.3% | C-1 0.3% | o | o | o | o |
| 2 | Ni | Au | A-1 0.01% | B-1 0.3% | C-2 0.3% | o | o | o | o |
| 3 | Ni | Au | A-1 0.01% | B-1 0.3% | C-1 0.15%<br>C-2 0.15% | o | o | o | o |
| 4 | Ni | Au | A-2 0.01% | B-1 0.3% | C-1 0.3% | o | o | o | o |
| 5 | Ni | Au | A-3 0.01% | B-1 0.3% | C-1 0.3% | o | o | o | o |
| 6 | Ni | Au | A-1 0.005%<br>A-2 0.005% | B-1 0.3% | C-1 0.3% | o | o | o | o |
| 7 | Pd—Ni | Au | A-2 0.01% | B-1 0.3% | C-1 0.3% | o | o | o | o |
| 8 | Ni | Au—Co | A-2 0.01% | B-1 0.3% | C-1 0.3% | o | o | o | o |
| 9 | Ni | Au | Untreated | | | o | x | x | x |
| 10 | Ni | Au | A-2 0.01% | | | o | o | o | x |
| 11 | Ni | Au | A-2 0.01% | | C-1 0.3% | o | o | o | ■ |
| 12 | Ni | Au | | B-1 0.3% | C-1 0.3% | o | x | x | o |
| 13 | Ni | Au | | | C-1 0.3% | o | x | x | ■ |
| 14 | Ni | Au | A-2 0.0005% | B-1 0.3% | C-1 0.3% | o | ■ | ■ | o |
| 15 | Ni | Au | A-2 2.0% | B-1 0.3% | C-1 0.3% | ■ | ■ | ■ | o |
| 16 | Ni | Au | A-2 0.01% | B-1 0.01% | C-1 0.3% | o | o | o | ■ |
| 17 | Ni | Au | A-2 0.01% | B-1 5.0% | C-1 0.3% | x | o | x | o |
| 18 | Ni | Au | A-2 0.01% | B-1 0.3% | C-1 0.01% | o | o | o | ■ |
| 19 | Ni | Au | A-2 0.01% | B-1 0.3% | C-1 5.0% | x | o | x | o |

Note 1)

Symbols for representing components of treating solutions in the table are as follows:

A-1: benzotriazole

A-2: sodium salt of mercaptobenzothiazole

A-3: sodium salt of 1,3,5-triazinethiol

B-1: oleic acid

C-1: lauryl acid phosphoric monoester (monolauryl phosphate)

C-2: lauryl acid phosphoric diester (dilauryl phosphate)

Note 2)

Criteria of test (1) Initial contact resistance and contact resistance after corrosion test o: not more than 10 mΩ

■: more than 10 to 20 mΩ x: more than 20 mΩ

(2) Appearance after corrosion test o: not more than 10 in the number of corrosion points in an area of 5 cm square of an enlarged photograph at a magnification of 50

■: more than 10 to 50 in the number of corrosion points in an area of 5 cm square of an enlarged photograph at a magnification of 50 x: more than 50 in the number of corrosion points in an area of 5 cm square of an enlarged photograph at a magnification of 50

(3) Lubricity (insertion and removal forces)

o: insertion force of not more than 100 g per pin and removal force of more than 50 g per pin ■: insertion force of more than 100 to 150 g per pin and removal force of more than 50 to 100 g per pin x: insertion force of more than 150 g per pin and removal force of more than 100 g per pin As described above, the treating solution of the present invention is free from such a substance as will contaminate the environment, and gold- and gold-alloy-plated materials treated with this solution have excellent corrosion resistance and lubricity.

What is claimed is:

1. A treating solution for a gold- or gold-alloy-plated material having nickel or a nickel-containing alloy as an underplating on a metallic material, said treating solution consisting essentially of: 0.001 to 1% by weight in total of at least one inhibitor selected from the group consisting of benzotriazole compounds represented by the following general formula (1), mercaptobenzothiazole compounds represented by the following general formula (2), and triazine compounds represented by the following general formula (3)

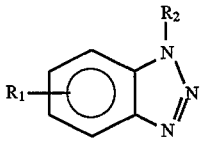

(1)

wherein $R_1$ represents hydrogen, an alkyl, or a substituted alkyl and $R_2$ represents an alkali metal, hydrogen, an alkyl, or a substituted alkyl,

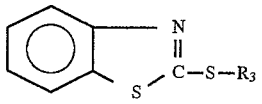

(2)

wherein $R_3$ represents an alkali metal or hydrogen, and

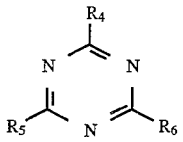

(3)

wherein $R_4$ represents -SH, an alkyl- or aryl-substituted amino group, or an alkyl-substituted imidazolylalkyl, $R_5$ and $R_6$ represent each $-NH_2$, -SH, or -SM wherein M represents an alkali metal;

0.05 to 2% by weight in total of at least one lubricant selected from the group consisting of fatty acids represented by the following general formula (4)

$$R_7\text{—COOH} \quad (4)$$

wherein $R_7$ represents a saturated or unsaturated chain hydrocarbon radical having 10 to 20 carbon atoms;

0.05 to 2% by weight in total of at least one emulsifier selected from the group consisting of monoalkyl phosphates represented by the following general formula (5) and dialkyl phosphates represented by the following general formula (6)

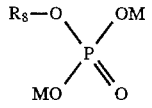

(5)

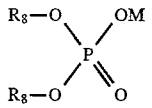

(6)

wherein $R_8$ represents an alkyl or a substituted alkyl and M represents hydrogen or an alkali metal, and a solvent selected from the group consisting of water and a halogen-free organic solvent.

2. The treating solution of claim 1, wherein said solvent is water.

3. A treating solution for a gold- or gold-alloy-plated material having nickel or a nickel-containing alloy as an underplating on a metallic material, said treating solution comprising: 0.001 to 1% by weight in total of at least one inhibitor selected from the group consisting of mercaptobenzothiazole compounds represented by the following general formula (2) and triazine compounds represented by the following general formula (3)

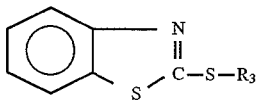

(2)

wherein $R_3$ represents an alkali metal or hydrogen, and

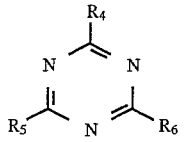

(3)

wherein $R_4$ represents -SH, an alkyl- or aryl-substituted amino group, or an alkyl-substituted imidazolylalkyl, $R_5$ and $R_6$ each represent $-NH_2$, -SH, or -SM wherein M represents an alkali metal;

0.05 to 2% by weight in total of at least one lubricant selected from the group consisting of fatty acids represented by the following general formula (4)

$$R_7\text{—COOH} \quad (4)$$

wherein $R_7$ represents a saturated or unsaturated chain hydrocarbon radical having 10 to 20 carbon atoms; and 0.05 to 2% by weight in total of at least one emulsifier selected from the group consisting of monoalkyl phosphates represented by the following general formula (5) and dialkyl phosphates represented by the following general formula (6)

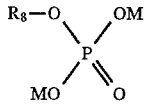

(5)

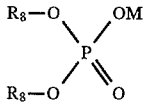

(6)

wherein $R_8$ represents an alkyl or a substituted alkyl and M represents hydrogen or an alkali metal.

4. A treating solution for a gold- or gold alloy-plated material having nickel or a nickel-containing alloy as an underplating on a metallic material, said treating solution consisting essentially of: 0.001 to 1% by weight in total of at least one inhibitor selected from the group consisting of mercaptobenzothiazole compounds represented by the following general formula (2) and triazine compounds represented by the following general formula (3)

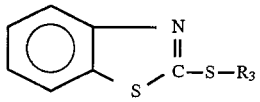

(2)

wherein $R_3$ represents an alkali metal or hydrogen, and

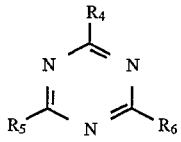

(3)

wherein $R_4$ represents -SH, an alkyl- or aryl-substituted amino group, or an alkyl-substituted imidazolylalkyl, $R_5$ and $R_6$ each represent $-NH_2$, -SH, or -SM wherein M represents an alkali metal;

0.05 to 2% by weight in total of at least one lubricant selected from the group consisting of fatty acids represented by the following general formula (4)

$$R_7\text{—COOH} \quad (4)$$

wherein $R_7$ represents a saturated or unsaturated chain hydrocarbon radical having 10 to 20 carbon atoms;

0.05 to 2% by weight in total of at least one emulsifier selected from the group consisting of monoalkyl phosphates represented by the following general formula (5) and dialkyl phosphates represented by the following general formula (6)

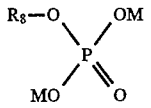

(5)

-continued

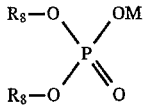

(6)

wherein $R_8$ represents an alkyl or a substituted alkyl and M represents hydrogen or an alkali metal, and a solvent selected from the group consisting of water and a halogen-free organic solvent.

5. The treating solution of claim 4, wherein said solvent is water.

* * * * *